United States Patent [19]

Amano et al.

[11] 4,246,066

[45] Jan. 20, 1981

[54] METHOD FOR PRODUCING FIBROUS SHEET

[75] Inventors: Masahiro Amano; Takashi Koike, both of Tokyo, Japan

[73] Assignee: Mitsubishi Paper Mills, Ltd., Tokyo, Japan

[21] Appl. No.: 30,371

[22] Filed: Apr. 16, 1979

Related U.S. Application Data

[63] Continuation of Ser. No. 779,589, Mar. 21, 1977, abandoned, which is a continuation of Ser. No. 656,592, Feb. 9, 1976, abandoned.

[30] Foreign Application Priority Data

Feb. 12, 1975 [JP] Japan ..... 50/16815

[51] Int. Cl.[3] ..... D21H 5/12; D21H 3/42

[52] U.S. Cl. ..... 162/141; 162/152; 162/157 R; 162/164 R; 162/166; 162/168 R; 162/169; 162/175; 162/183

[58] Field of Search ..... 162/164 R, 164 EP, 168 R, 162/168 N, 169, 183, 141, 152, 157 R, 175, 157 C, 166; 260/29.6 NR, 29.6 PT

[56] References Cited

U.S. PATENT DOCUMENTS

| | | | |
|---|---|---|---|
| 3,766,002 | 10/1973 | Grief et al. | 162/168 R |
| 3,776,812 | 12/1973 | Jongettes | 162/183 |
| 3,937,648 | 2/1976 | Huebner et al. | 162/168 R |

FOREIGN PATENT DOCUMENTS

| | | | |
|---|---|---|---|
| 1338759 | 11/1973 | United Kingdom | 162/169 |

*Primary Examiner*—Peter Chin

*Attorney, Agent, or Firm*—Cushman, Darby & Cushman

[57] ABSTRACT

A fibrous sheet having a high strength and water resistance and having no resin specks on the surface can be produced by producing a sheet from a fiber slurry by the known paper making process, to said fiber slurry being added a flocculate of chlorinated polymer latices which has a particle size of 100μ–500 μ and is prepared by heating said chlorinated polymer latices to a temperature of at least their minimum film-forming temperature and then adding a water soluble cationic polymer or a polyvalent metal salt with stirring. Examples of said chlorinated polymer latices are anionic polyvinyl chloride latex, polyvinylidene chloride latex or the combination thereof.

11 Claims, No Drawings

METHOD FOR PRODUCING FIBROUS SHEET

This is a continuation, of application Ser. No. 779,589 filed Mar. 21, 1977, which was a continuation of Ser. No. 656,592, filed Feb. 9, 1976, both of which are now abandoned.

BACKGROUND OF THE INVENTION

The present invention relates to a method for producing a fibrous sheet and more particularly to the so-called internal application of latex in production of a fibrous sheet by known wet paper making technique or wet non-woven fabric making technique which comprises previously flocculating a chlorinated polymer latex into a flocculate of 100–500μ in particle size, adding the resultant flocculate to a fiber slurry which is separately prepared, making the slurry into a sheet and drying the resultant sheet.

The method for internal application of latex is roughly classified into the following two techniques.

(1) The so-called beater addition which comprises flocculating a latex in a fiber slurry to deposite the latex onto the surface of the fibers.

(2) The method which comprises previously producing a flocculate of a latex and adding the flocculate to a fiber slurry which has been separately prepared. (In this case, said flocculate is retained in the sheet by filtering action.)

The present invention belongs to the technical field (2) and a novel method for controlling the particle size of chlorinated polymer latex such as anionic polyvinyl chloride (referred to as "PVC" hereinafter) latex, polyvinylidene chloride (referred to as "PVDC" hereinafter) latex, or combination thereof which has been difficult to attain has been found.

Hitherto, said method (1) which comprises adding a latex to a beater has been carried out in the production of papers and boards. However, according to such method, various troubles in paper making are apt to occur when the latex is added in a great amount of more than 20% by weight of fiber. Therefore, said method (2) has been mainly employed in the production of non-woven fabrics where a large amount of latex is often used.

However, since the retention of the latex in the sheet depends upon only the filtering action, it is needless to say that control of the size of the latex flocculate is very important.

As the result of various experiments by the inventors, it has been found that a flocculate of 100μ–500μ in particle size is optimum although the optimum particle size may somewhat vary depending on the thickness and shape of the fibers.

A large flocculate having a particle size of more than 500μ shows 100% retention, but the resultant sheet has specks and tends to adhere to the surface of drier.

In the case of a flocculate of less than 100μ in particle size, retention is not satisfactory and the necessary strength cannot be obtained and moreover the waste water is markedly contaminated. According to the present invention, novel conditions for flocculation of chlorinated polymer latices such as anionic PVC latex and PVDC latex which are difficultly controlled in particle size of their flocculates have been found.

The particles size of the flocculate is defined as maximum diameter which passes through the center of each flocculate when observed under a microscope.

When anionic PVC and PVDC latices are flocculated with water soluble cationic polymers or polyvalent metal salts by the conventional technique, only such flocculates having a particle size of less than 50μ, mostly 10–20μ are obtained even under a very slow stirring condition. As the result of the inventors' intensive research in an attempt to obtain a stable flocculate of 100μ–500μ in particle size, it has been found that a latex finally becomes a stable flocculate through the following stages.

That is, when a flocculate is produced by adding water soluble cationic polymers or polyvalent metal salt to an anionic PVC or PVDC latex, the latex grows to a flocculate of 1 mm to 10 mm for the first several seconds by the shock of the addition, thereafter redispersion of the flocculate occurs to give the form of grape bunch and then the dispersion becomes a flocculate of about 10 to 30μ in particle size in such a manner that individual grapes fall from the bunch.

It has also been confirmed that the same progress of flocculation as mentioned above follows when an anionic acrylic latex is flocculated with a water soluble cationic polymer under relatively mild flocculation conditions, but what is different from the flocculation of the anionic PVC and PVDC latices is that the acrylic latex is difficulty redisperred into the flocculate finer than the state of the grape bunch and so the floccuate is stabilized in the form of coarse flocculate (200μ to 1 mm). Furthermore, it has also been recognized that in the case of radical flocculation with an aluminum salt, the flocculates of 1 mm to 10 mm produced due to the shock of addition gather to form masses of the flocculate.

From the above results, it has been found that the adhesion power within the flocculate of latex has a remarkable influence on the particle size of the final flocculate and hence the minimum film-forming temperature (abbreviated as "MFT" hereinafter) of the latex holds the key.

SUMMARY OF THE INVENTION

That is, the present invention provides a method for producing a fibrous sheet which comprises heating at least one chlorinated polymer latex such as anionic PVC latex and PVDC latex or combination thereof to a temperature of at least the MFT of said latex, adding thereto a water soluble cationic polymer or a polyvalent metal salt with stirring to produce a flocculate having a particle size of 100μ–500μ, adding thus obtained flocculate to a fiber slurry which is separately prepared, producing a sheet therefrom by known paper making method and drying the resultant sheet.

With increase in the heating temperature than the MFT, the particle size of the final flocculate becomes larger and with decrease in the heating temperature, the particle size becomes smaller. This is because the inner adhesion power of the latex flocculate is increased and redispersion of the flocculate caused by stirring is prevented. Therefore, it is important to previously and experimentally determine the temperature by which a flocculate having a particle size of 100μ–500μ which is suitable for paper making is obtained.

It is clear that after the particle size of the flocculate is stablized, the temperature may be lowered and keeping warm is not especially required.

DESCRIPTION OF THE PREFERRED EMBODIMENTS

The chlorinated polymer latex includes anionic polyvinyl chloride (PVC) latex and polyvinylidene chloride (PVDC) latex which are latices emulsified with an anionic surfactant and which are flocculated with a water soluble cationic polymer or a polyvalent metal salt.

Said anionic PVC latex and PVDC latex include not only homopolymers of vinyl chloride or vinylidene chloride, but copolymers of vinyl chloride and vinylidene chloride and copolymers with other vinyl monomers such as vinyl acetate, arcylic esters, etc. or unsaturated acid such as maleic acid, etc. It will be clear that those to which external plasticizer is added to lower the MFT are also included.

Preferably, these latices are diluted to 0.5–10% by weight prior to flocculation and when the concentration is too high, collision of the flocculated particles becomes too violent and coarse mass is apt to be produced.

The water soluble cationic polymers used herein are resins which exhibit cationic property in water. Especially useful resins are polyamide-polyamine-epichlorohydrin resins, polyethyleneimine resins, cationic modified melamine formalin resins, cationic modified urea formalin resins, etc. Many of these polymers are used in the form of an initial condensate and these are also useful as retention increasing agent, wet strength increasing agent and freeness adjusting agent for paper making. Furthermore, cationic modified starch may also be used.

As the polyvalent metal salts, aluminum salts, calcium salts and magnesium salts are especially useful.

Amount of these additives cannot be specified because there are differences in chemical stability of the latex used, but it is sufficient to add in the mimimum amount required for completely flocculate the latex and the amount should not exceed 1.5 time the minimum necessary amount.

The fibers used may be any of natural fibers, regenerated fibers, synthetic fibers, inorganic fibers, metallic fibers, collagen fibers, etc. or mixtures thereof. Furthermore, sizing agent, filler, freeness adjusting agent, dispersion adjusting agent, etc. may also be added in the fiber slurry.

The amount of flocculate to be added to the fiber slurry is 10–300 parts by weight, preferably 10–150 parts per 100 parts of fibers.

The percent of weight and part used herein are all in terms of solid matter unless otherwise specified.

The present invention will be illustrated in the following Examples.

EXAMPLE 1

500 l of 5 weight % diluted liquid of Geon 576 (polyvinyl chloride-acrylate copolymer containing an external plasticizer (dioctyl phthalate) prepared by Nihon Geon K. K. and having a MFT of 50° C.) was heated to 55° C. with stirring in such a manner that no bubbling occurred. To said liquid was added 55 kg of 2 weight % aqueous solution of Polyfix 201 (a polyamide·polyamine·epichlorohydrin water soluble cationic polymer prepared by Syowa Kobunshi K. K.) to obtain a homogeneous flocculate having a particle size of 100μ–500μ.

This flocculate was stable even after allowed to stand for about 50 hours under stirring. Said flocculate was added in an amount as shown in Table 1 to various fiber slurries as shown in Table 1 and fibrous sheets were produced from these slurries by the known wet paper making method and the result sheets were dried. Properties of the sheets are shown in Table 1, namely, they had a high strength and water resistance and had no resin specks on the surface. Furthermore, no troubles occured in paper making procedure.

TABLE 1

| | | Pulp 100% paper | Non-woven fabric | Synthetic pulp paper |
|---|---|---|---|---|
| Blending of fibers | | NBKP 100 parts | NBKP 20 parts Rayon 80 parts | Synthetic pulp 100 parts |
| Latex flocculate | | 100 parts | 30 parts | 100 parts |
| Basis weight ($g/m^2$) | | 86.4 | 51.8 | 96.2 |
| Tensile strength (kg/15 mm width) | Dry | 4.4 | 1.8 | 2.1 |
| | Wet | 1.6 | 0.9 | 1.1 |
| Elongation (%) | Dry | 8.8 | 13.9 | 69.4 |
| | Wet | 12.3 | 27.6 | 51.1 |
| MIT folding endurance (times) (load of 1 kg) | | more than 10,000 | 8,000 | more than 20,000 |
| Cantilever bending resistance (mm) | | 130 | 112 | 96 |

Note:
(1) "Rayon": 1.5 denier, 10 mm length and produced by Mitsubishi Rayon K.K.
(2) "Synthetic pulp": Trade name "SWP" produced by Mitsui Zellerbach K.K.
(3) "Tensile strength" and "Elongation" (at breaking): TENSILON (TOYO MEASURING INSTRUMENTS CO., LTD.; Length of test piece . . . . . 10 cm; Speed . . . . . 50 mm/min.
(4) "MIT folding endurance": In accordance with Tappi Standard T-511-Su-69, Load . . . . . 1 kg.
(5) "Cantilever bending resistance": In accordance with JIS L-1079A.

COMPARATIVE EXAMPLE

Example 1 was repeated except that the PVC latex was not heated, but the operation was carried out at 20° C. to obtain a flocculate having a particle size of 20μ–30μ, from which a non-woven fabric was produced. Properties of the resultant non-woven fabric are shown in Table 2. Such fabric could not practically be used.

TABLE 2

| | | Non-woven fabric |
|---|---|---|
| Blending of fibers | NBKP | 20 parts |
| | Rayon | 80 parts |
| PVC flocculate | | 30 parts |
| Basis weight ($g/m^2$) | | 46.3 |
| Tensile strength (kg/15 mm width) | Dry | 0.5 |
| | Wet | 0.1 |
| Elongation (%) | Dry | 8.3 |
| | Wet | 7.6 |
| MIT folding endurance (load of 1 kg) | | — |
| Cantilever bending resistance (mm) | | 53 |

EXAMPLE 2

500 l of 5 weight % diluted liquid of Geon 351 (PVC latex prepared by Nihon Geon K. K. and having a MFT of 70° C.) was heated to 73° C. with stirring in such a manner that no bubbling occurred. To this liquid was added 17.5 kg of calcium chloride liquid having a concentration of 0.5 mol to obtain a flocculate having a particle size of 100μ–500μ.

This flocculate was stable even after allowed to stand for about 50 hours.

Said flocculate was added in an amount as shown in Table 3 to fiber slurries as shown in Table 3. Fibrous sheets were produced from the slurries by the known wet paper making and the resultant sheets were dried. Properties of the sheets are shown in Table 3. That is, they had a high dry and wet strengths and had no resin specks on the surface. Furthermore, no troubles occurred in paper making.

Since the fibers used in sample B in Table 3 were heat resistant fibers (Normex) and flameproofing fibers (Kynol) and the latex used was also excellent in fire retardancy, the resultant sheet had markedly excellent flameproofness.

TABLE 3

| | | A | B |
|---|---|---|---|
| Blending of fibers | | NBKP 20 parts<br>Rayon 80 parts | Kynol 70 parts<br>Normex 30 parts |
| PVC flocculate | | 30 parts | 30 parts |
| Basis weight (g/m$^2$) | | 49.6 | 97.4 |
| Tensile strength (kg/15 mm width) | Dry | 1.8 | 4.7 |
| | Wet | 0.8 | 3.2 |
| Elongation (%) | Dry | 13.0 | 6.9 |
| | Wet | 25.0 | 5.3 |
| MIT folding endurance resistance (times) (load of 1 kg) | | 7,000 | 1,000 |
| Cantilever bending resistance (mm) | | 118 | 156 |
| Vertical test flammability test | After-flame time (second) | | 0 |
| | After-glow time (second) | | 0 |
| | Char length (cm) | | 3 |

(Notes):
(1) Kynol: Flameproofing fibers produced by Nihon Kynol K.K. (Phenol resin fibers, 2 deniers and 10 mm in length)
(2) Nomex: Heat resistant fibers produced by Du Pont de Nemours (aromatic polyamide fibers, 2 deniers and 6 mm in length)
(3) Vertical flammability test: In accordance with JIS L-1091-73R, A-4 method

EXAMPLE 3

500 l of 1 weight % diluted liquid of Saran Latex N (Polyvinylidene chloride-acrylate copolymer prepared by Asahi Dow K. K. and having a MFT of 60° C.) was heated to 65° C. with stirring in such a manner that no bubbling occurred. To this liquid was added 4.1 kg of 2 weight % aqueous solution of Polyfix 201 to obtain a homogeneous flocculate dispersion having a particle size of 100μ–500μ, which was stable even after allowed to stand for about 50 hours under stirring. Separately, a fiber slurry was prepared by dispersing Kynol fibers.

To this fiber slurry was added said flocculate in an amount of 30% by weight of the fibers and then a fibrous sheet was produced therefrom by paper making and dried.

Properties of the resultant sheet were nearly the same as those of sample B in Example 2, namely, the sheet was excellent in dry and wet strength and had the excellent flameproofness.

No troubles occurred in the paper making. Furthermore, there were no resin specks on the sheet.

EXAMPLE 4

500 l of 2 weight % diluted liquid of a mixed latex of Geon 351 and Saran N (1:1 in solid matter) was heated to 75° C. with stirring in such a manner that no bubbling occurred. To this liquid was added 14 kg of 1.25 weight % aqueous solution of Polymin SN (polyethyleneimine cationic polymer prepared by BASF Dyes & Chemicals, LTD.) to obtain homogeneous flocculate having a particle size of 200μ–500μ. This flocculate was stable even after allowed to stand for about 50 hours under stirring. Then, a slurry having the same fiber blend as sample A in Example 2 was prepared. To this slurry was added said flocculate in an amount of 30% by weight of the fibers. A fibrous sheet was produced from said slurry by paper making and dried.

The resultant sheet had the satisfactory strength similar to that of non-woven fabric A in Example 2.

No troubles occurred in the paper making and there were no resin specks on the sheet.

What is claimed is:

1. A method for producing a fibrous sheet which comprises the successive steps of:

(1) heating chlorinated polymer latex having a minimum film-forming temperature of at least 50° C. and comprising
an anionic polyvinyl chloride latex, or
an anionic polyvinylidine chloride latex selected from the group consisting of homopolymer of vinyl chloride, homopolymer of vinylidene chloride, vinyl chloride-vinylidene chloride copolymer, vinyl chloride-vinyl acetate copolymer and vinylidene chloride-vinyl acetate copolymer, the latex being emulsified with an anionic surfactant;
to a temperature of at least the minimum film-forming temperature of said latex, (2) adding a water soluble cationic polymer or a polyvalent metal salt to said latex with stirring producing a flocculate having a particle size of 100 microns to 500 microns, (3) adding the resultant flocculate to a separately prepared fiber slurry, (4) forming a sheet from said slurry by a wet paper making process, and thereafter (5) drying the thus formed sheet.

2. A method according to claim 1 wherein the amount of flocculate is 10–30 parts per 100 parts of fibers.

3. A method according to claim 1 wherein there is added a water soluble cationic polymer which is a polyamide-polyamine-epichlorohydrin resin, a polyethyleneimine resin, a cationic modified melamine-formaldehyde resin, a cationic modified urea-formaldehyde resin or a cationic modified starch.

4. A method according to claim 1 wherein there is added a polyvalent metal salt which is an aluminum salt, a calcium salt, or a magnesium salt.

5. A method according to claim 1 wherein the amount of the water soluble cationic polymer or polyvalent metal salt is less than 1.5 times the minimum amount required for complete flocculation of the latex.

6. A method according to claim 1, wherein the fibers are natural fibers, regenerated fibers, synthetic fibers, inorganic fibers, metallic fibers, collagen fibers or mixtures thereof.

7. A method according to claim 1 wherein the chlorinated polymer is vinyl chloride homopolymer.

8. A method according to claim 1 wherein the minimum film-forming temperature is 50° to 70° C.

9. A method according to claim 1 wherein the chlorinated polymer is vinyl chloride-acrylate ester copolymer.

10. A method according to claim 1 wherein the chlorinated polymer is vinylidene chloride-acrylate ester copolymer.

11. A method for producing a fibrous sheet which method comprises the successive steps of:

(1) heating a chlorinated polymer latex having a minimum film-forming temperature of at least 50° C. and comprising an anionic polyvinyl chloride latex, or an anionic polyvinylidene chloride latex selected from the group consisting of homopolymer of vinyl chloride, homopolymer of vinylidene chloride, vinyl-chloride-vinylidene chloride copolymer, vinyl chloride-acrylate ester copolymer, vinylidene chloride-acrylate ester copolymer, vinyl chloride-vinyl acetate copolymer and vinylidene chloride-vinyl acetate copolymer, the latex being emulsified with an anionic surfactant to a temperature of at least the minimum film-forming temperature of said latex, (2) adding a water soluble cationic polymer or a polyvalent metal salt to said latex with stirring thereby producing a flocculate having a particle size of 100 microns to 500 microns, (3) adding the resultant flocculate to a separately prepared fiber slurry, (4) forming a sheet from said slurry by a wet paper making process, and thereafter (5) drying the thus formed sheet.

* * * * *